US005743446A

United States Patent [19]

Roda-Balzarini

[11] Patent Number: 5,743,446

[45] Date of Patent: Apr. 28, 1998

[54] DEVICE TO FACILITATE THE ACT OF PUTTING ON HOSIERY

[76] Inventor: Emilio Roda-Balzarini, Via Bottogno 11b, 6962 Viganello, Switzerland

[21] Appl. No.: 714,427

[22] Filed: Sep. 16, 1996

[30] Foreign Application Priority Data

Sep. 22, 1995 [CH] Switzerland ..... 02677/95

[51] Int. Cl.[6] ..... A57G 25/90

[52] U.S. Cl. ..... 223/112

[58] Field of Search ..... 223/112, 118, 223/120, 111

[56] References Cited

U.S. PATENT DOCUMENTS

| | | | |
|---|---|---|---|
| 4,896,803 | 1/1990 | Wilkens | 223/112 |
| 5,050,783 | 9/1991 | Hunter | 223/112 |
| 5,082,154 | 1/1992 | French | 223/120 |
| 5,593,071 | 1/1997 | Lusk | 223/112 |

*Primary Examiner*—Bibhu Mohanty
*Attorney, Agent, or Firm*—Young & Thompson

[57] ABSTRACT

Device (1) to help an elderly or disabled person to put on hosiery, wherein it comprises:

hollow elements (2) of tubular shape and having hole (2*a*) which allows insertion and admission of the end of the lower limb; hole (2*a*) has an outer edge (2*b*) which allows an item of hosiery to be slipped over it and slid axially along the outside of tubular elements (2);

elements (5, 6, 7) capable of varying the dimensions of hole (2*a*);

elements (5) capable of rotating tubular elements (2) around longitudinal axis (K—K);

support elements (8) for holding up device (1).

5 Claims, 3 Drawing Sheets

DEVICE TO FACILITATE THE ACT OF PUTTING ON HOSIERY

FIELD OF THE INVENTION

This invention relates to the field of devices which can be used to help an elderly, feeble or disabled person perform simple tasks such as putting on clothing, tasks essential to daily life.

In particular, the device which is the object of this invention is designed to help an elderly, feeble or disabled person put on any type of hosiery, including elasticized hosiery or therapeutic hosiery. Putting on hosiery is especially difficult for these individuals because of the movements required to perform the act, which necessarily include a deep flexing of the torso and bending of the lower limbs so that all the joints are on the same level, not to mention the fact that in the case of elastic hose, considerable physical effort is required.

To assist individuals in need, the inventor of this invention has designed a device which makes it possible to put on hosiery while making only those movements which are easy for the majority of individuals, including those with congenital or noncongenital temporary or permanent disabilities.

SUMMARY OF THE INVENTION

The device according to the invention is characterized by the following:

a) hollow means having an essentially tubular shape and having a hole which allows insertion and admission, along its longitudinal axis, of the end of the limb up to a predetermined distance, said hole having an outside edge which allows an item of hosiery to be put on around it and slid axially along the outside of said hollow tubular means up to a desired length;

b) means capable of varying the dimensions of said hole within predetermined limits;

c) means capable of rotating said tubular means around an axis perpendicular to its own longitudinal axis;

d) support means for holding up the device.

BRIEF DESCRIPTION OF THE DRAWINGS

A more detailed description will hereby be given of several embodiments of the invention and its method of use, with reference to the attached diagrams which represent the following.

DETAILED DESCRIPTION OF THE INVENTION

Figure 1:
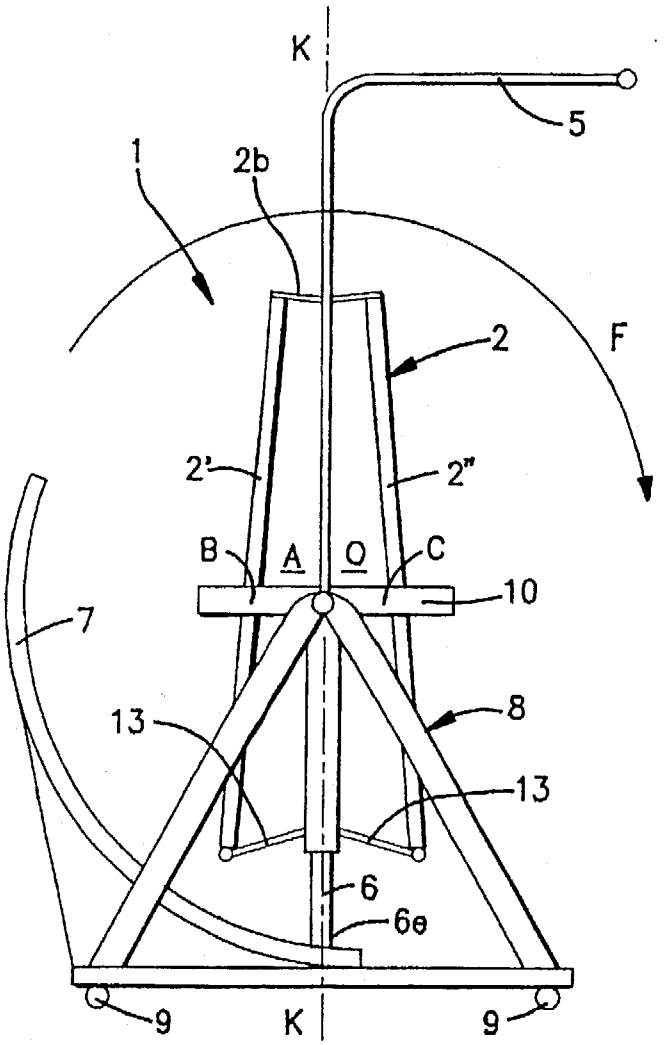
FIG. 1 shows a lateral view of a preferred embodiment of the invention in rest position.

FIG. 1 shows one preferred embodiment of the invention, which comprises support 8 with triangular cross-section located below and mounted on rotating bodies 9 such as wheels or the like.

Attached to support 8 is stirrup 10 and curved guide 7. Stirrup 10 is hinged at point A of support 8, at the vertex of the triangle formed by said support, thereby being supported while freely rotating.

Also hinged to stirrup 10 at predetermined points B and C located at their median zones there are two symmetrical mirrored parts 2', 2" which are two halves facing one another, forming a hollow casing 2 of tubular shape.

Each of these two halves 2', 2" has at one end a part with semicircular edge so that by bringing the two together to face one another, a more or less circular hole **2*a* is formed having edge 2*b***.

At the other end, these two halves 2', 2" are connected via jointed elements (arms) 13 to member 6 which acts more or less like a strut and which is inserted into device 1 in such a way as to be able to slide along longitudinal axis K—K of casing 2 formed by the two halves 2', 2".

Aforementioned curved guide 7 is removed from and/or connected to support 8 of device 1 in such a way that its center of curvature 0 does not coincide with point A through which the hinge axis of said stirrup 10 passes.

Figure 2:
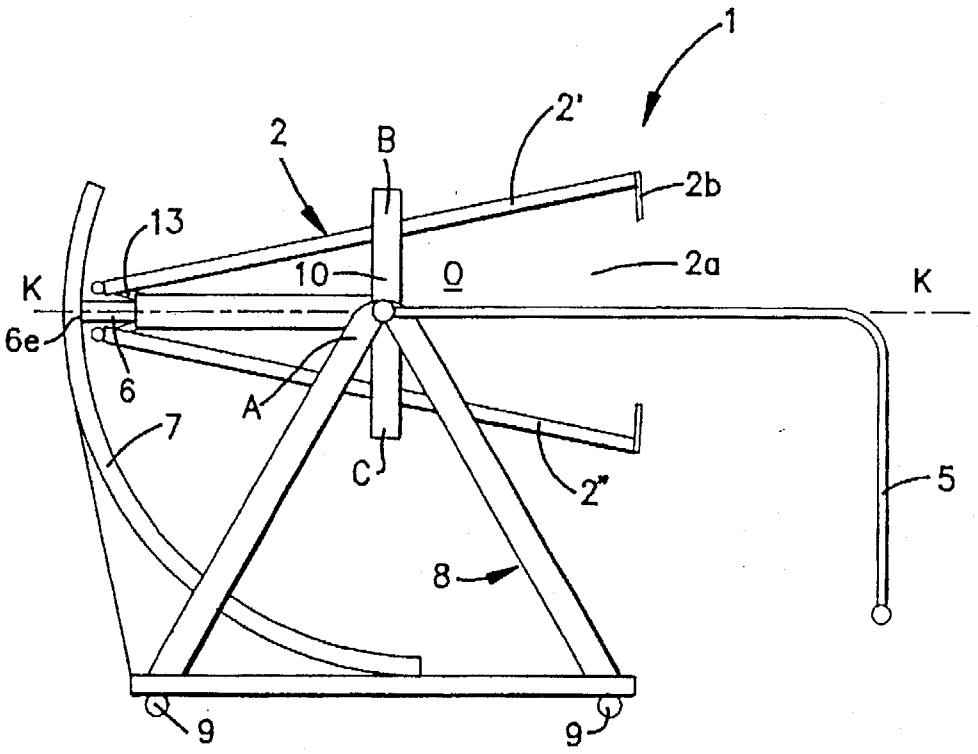
FIG. 2 shows a lateral view of a situation in which the entrance hole of the hollow means is dilated to allow insertion of a lower limb.

Consequently, using any one, but preferably two levers 5 with grip, stirrup 10 can be made to rotate in the clockwise direction as shown by arrow F in FIG. 1, with member 6 sliding along guide 7 and consequently also sliding along longitudinal axis K—K of casing 2, thereby causing the two halves forming this casing to rotate twice in the opposite direction around their hinge points B, C, with the result that their ends connected to member 6 come together, and the opposite ends which form hole **2*a* of casing 2 are drawn away from one another, consequently dilating hole 2*a* to a predetermined size as shown in FIG. 2**.

Figure 3B:
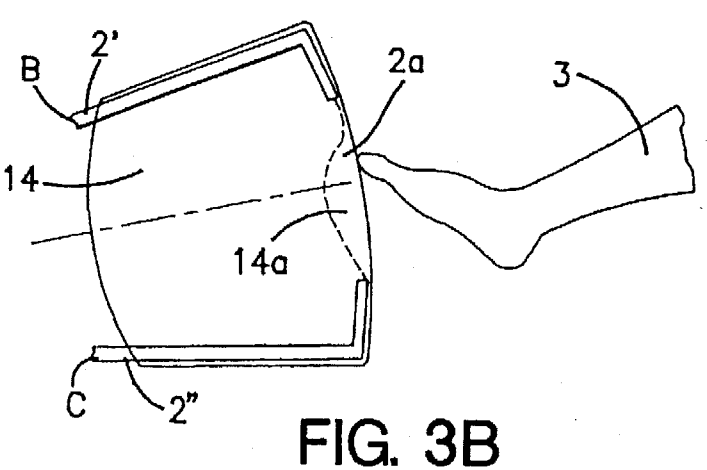
FIGS. 3, 3A, 3B, 3C, 3D and 3E are lateral views of only that part of the hollow means which includes the hole, at four successive moments during use of the device.
Figure 3A:
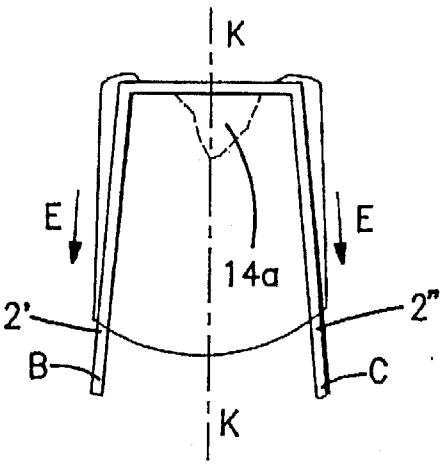
Figure 3:
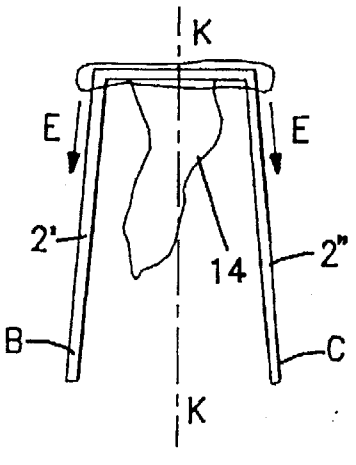
Figure 3E:
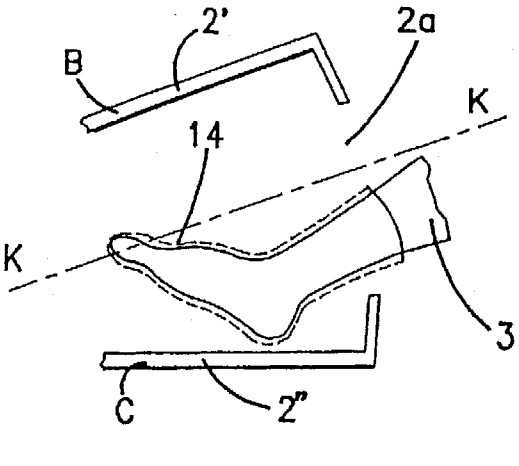
Figure 3D:
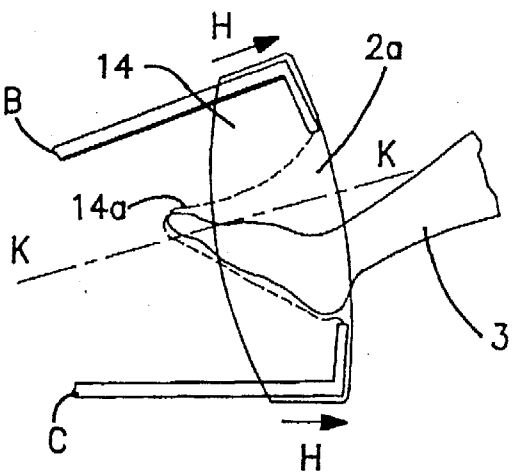
Figure 3C:
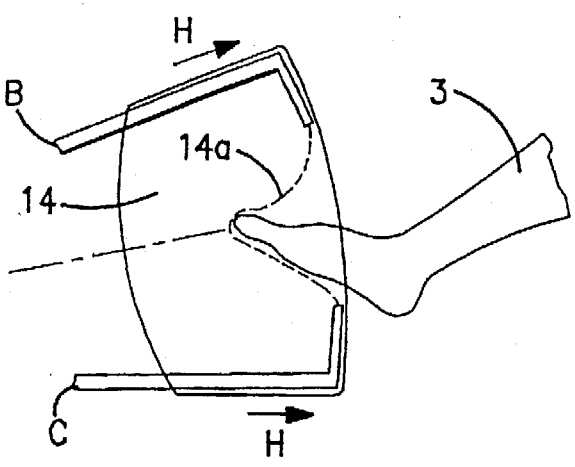

The inventor intends the mechanical operation described above to be executed in the following way, which is also illustrated in FIGS. 3, 3A, 3B, 3C, 3D and 3E: with the device in a rest position, that is, with hollow casing 2 in a vertical position as shown in FIG. 1, the garment 14 — whether a sock or elastic stocking or whatever it may be — is put on, turning it up around edge **2*b* of hole 2*a*, which in this position is small, and sliding it, still turned up, along the outer walls of casing 2 in the direction of arrow E as per FIGS. 3 and 3A, until closed end 14*a* of garment 14 — stretched to its full length — blocks hole 2*a* (as per FIG. 3A). If casing 2 is rotated in a clockwise direction by working lever 5, hole 2*a* can be dilated until it reaches a size which will allow insertion of the end of the lower limb (that is, the foot, ankle and possibly part of the calf) into casing 2 (FIG. 3B). By inserting limb 3 and exerting pressure on end 14*a* of garment 14 which is blocking hole 2*a*, then this part can be axially pulled into casing 2, causing the edges of the garment which have been slipped around casing 2 to slide outward (see arrow H in FIGS. 3C and 3D) and then, after limb 3 is inserted in a particular way, the garment can be put on over this limb (FIG. 3E**) without having to flex the torso and without having to assume positions which are ergonomically uncomfortable for an elderly or disabled person.

This embodiment as described and diagrammed is a preferred embodiment: other embodiments are possible by modifying the shape and/or operation of the parts which comprise device 1.

Figure 4:
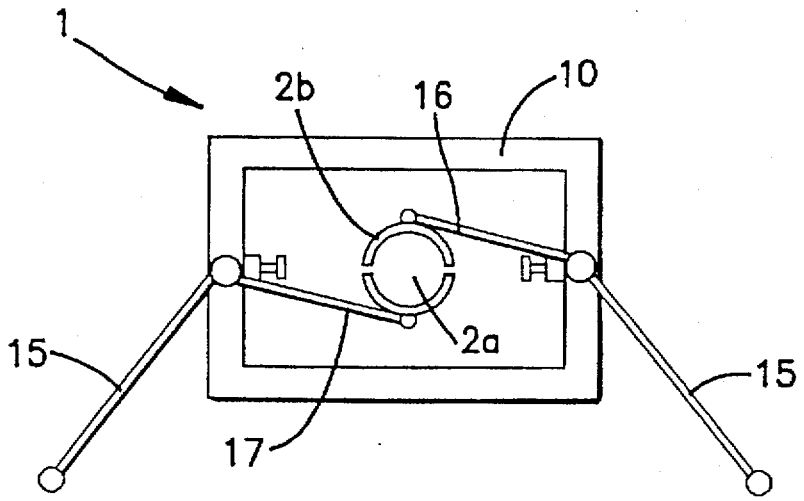
FIG. 4 shows a front view of another embodiment of the device in rest position.
Figure 5:
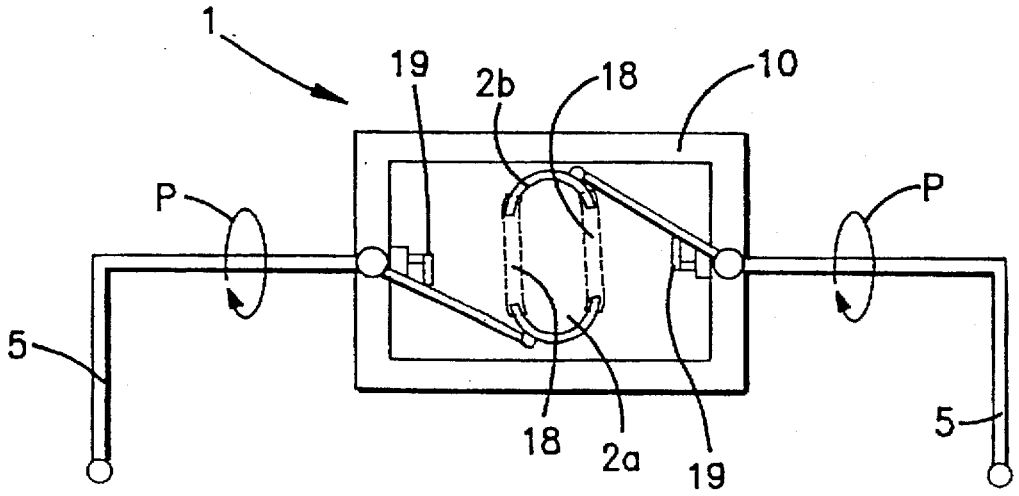
FIG. 5 shows the same view as FIG. 4, but in another embodiment, with the hole of the hollow means dilated to allow insertion of a lower limb.

For example, FIGS. 4 and 5 show another two embodiments conceived by the inventor: hole **2*a* can be dilated using a series of compound levers 16, 17** connected to lever 15, and in the second case, with a system of rotating levers 5 and cams 19.

Rotation of the levers is shown by arrow P; levers 5 and 15 can also be made in such a way as to telescopically extend and retract, to occupy a minimum amount of space when the device is not in use.

The inventor suggests that for edge 2*b* of hole 2*a*, the outer surface of hollow casing 2 be made with materials having a low coefficient of friction so as to enable the material composing stocking 14 or other garment to slide easily along the casing when device 1 is in use.

To avoid puncturing garment 14 on the corners of the ends of the semicircular edges of two halves 2', 2" of casing 2, the inventor designed it so that two halves 2', 2" can be smoothly connected using two parts of flexible tubing 18 (FIG. 5) threaded on over top of them and made for example of synthetic resin with a low coefficient of friction, joining the two facing ends of the edges of these two halves. Thus no matter how dilated hole 2*a* is, edge 2*b* remains closed while the hosiery is easily slid along.

It is not necessary for casing 2, when its two halves 2', 2" are facing one another, to be completely closed on the sides; but it is advisable that, as in the scenarios represented, the casing have enough empty space on the sides to allow easy movement of the limb and to allow the ends of the two halves of edge 2*b* to be connected as described.

Obviously, there are a great number of other embodiments conceivable which would not depart from the scope of the invention and therefore would be protected by this patent if they correspond to the description in the attached claims.

I claim:

1. Device (1) to help an elderly, feeble or disabled person to put on hosiery (14), characterized in that it comprises:

a) hollow means (2) having an essentially tubular shape and having hole (2*a*) which allows along its longitudinal axis (K—K) insertion and admission of the end of the lower limb (3) up to a predetermined distance, said hole having outside edge (2*b*) which allows an item of hosiery (4) to be put on around it and slid axially along the outside of hollow tubular means (2) up to a desired length;

b) means (5, 6, 7, 15, 16, 17, 19) capable of varying the dimensions of hole (2*a*) within predetermined limits;

c) means (5, 15) capable of rotating said tubular means around an axis perpendicular to its own longitudinal axis (K—K);

d) support means (8) for holding up device (1).

2. Device according to claim 1, wherein means (5, 6, 7) capable of varying the dimensions of hole (2*a*) can also simultaneously rotate tubular means (2).

3. Device according to claim 2, comprising:

support (8) mounted on rotating elements (9);

casing (2) of tubular shape comprising two halves (2', 2") facing one another and hinged in their median zone on stirrup (10) connected to support (8) in such a way as to rotate, both halves having at one end a semicircular edge and being connected at the other end via jointed elements (13) to member (6) capable of sliding along longitudinal axis (K—K) of casing (2); curved guide (7), having center of curvature (0) which does not coincide with hinge point (A) of stirrup (10) on support (8), and along which slides outer end (6*e*) of member (6) which can slide axially in casing (2);

at least one lever (5, 15) which can be gripped and connected to casing (2) in such a way as to make it rotate around its hinge point (A) on this support.

4. Device according to claim 3, wherein this lever or these levers (5, 15) can be extended and retracted telescopically.

5. Device according to claim 3, wherein the two halves of edge (2*b*) of this hole (2*a*) are smoothly connected via two parts of flexible tube (18) each of which is applied in such a way as to connect the two facing ends of the two halves of edge (2*b*).

* * * * *